US005236271A

United States Patent [19]

Sakaoka

[11] Patent Number: 5,236,271

[45] Date of Patent: Aug. 17, 1993

[54] AUTOMATIC MECHANICAL PENCIL

[75] Inventor: Gouji Sakaoka, Tokyo, Japan

[73] Assignee: Micro Co., Ltd., Japan

[21] Appl. No.: 465,579

[22] Filed: Jan. 18, 1990

Related U.S. Application Data

[63] Continuation of Ser. No. 171,137, Mar. 16, 1988, abandoned, which is a continuation of Ser. No. 871,484, Jun. 6, 1986, abandoned.

[30] Foreign Application Priority Data

Aug. 10, 1985 [JP] Japan ..... 60-174992

[51] Int. Cl.[5] ..... B43K 21/033; B43K 21/22

[52] U.S. Cl. ..... 401/65; 401/81; 401/94

[58] Field of Search ..... 401/53, 65, 67, 81, 401/94

[56] References Cited

U.S. PATENT DOCUMENTS

| | | | |
|---|---|---|---|
| 271,439 | 1/1883 | Eybel | 401/67 |
| 2,340,665 | 2/1944 | Jacobs | 401/65 |
| 3,804,536 | 4/1974 | Torii et al. | 401/65 X |
| 3,864,046 | 2/1975 | Butka | 401/67 X |
| 3,883,253 | 5/1975 | Naruse et al. | 401/65 |
| 4,003,664 | 1/1977 | Butka | 401/67 |
| 4,230,413 | 10/1980 | Gartner | 401/67 X |
| 4,270,870 | 6/1981 | Hashimoto et al. | 401/65 X |
| 4,478,529 | 10/1984 | Morio | 401/81 X |
| 4,538,934 | 9/1985 | Brunner | 401/81 X |

FOREIGN PATENT DOCUMENTS

| | | | |
|---|---|---|---|
| 2153400 | 5/1973 | Fed. Rep. of Germany | 401/67 |
| 3032200 | 3/1982 | Fed. Rep. of Germany | 401/81 |
| 55-5350 | 2/1980 | Japan | 401/67 |
| 2001011 | 1/1979 | United Kingdom | 401/67 |

*Primary Examiner*—Steven A. Bratlie

*Attorney, Agent, or Firm*—Bruce L. Adams; Van C. Wilks

[57] ABSTRACT

An automatic pencil for automatically dispensing a writing lead comprises a hollow, longitudinal main body for receiving therein lead, and a mouthpiece detachably connected at its rear end to a front end of the main body for projecting a top of the lead received in the main body from a front end of the mouthpiece. A slider is movably disposed in a front portion of the mouthpiece for frictionally holding therein the lead, the slider being manually, reciprocally moveable in the axial direction of the pencil in response to writing pressure applied thereto during use of the pencil. A chuck is mounted in a rear portion of the mouthpiece for releasably clamping the lead during use of the pencil such that the chuck operates in response to the reciprocating movement of the slider to allow advancing movement of the lead toward the front end of the mouthpiece and to prevent retracting movement of the lead. To facilitate replacement of the lead, the chuck is removable from the main body together with the slider when the mouthpiece is detached from the main body.

11 Claims, 1 Drawing Sheet

AUTOMATIC MECHANICAL PENCIL

This is a Rule 62 continuation U.S. patent application Ser. No. 171,137 filed Mar. 16, 1988 which in turn is a Rule 62 continuation U.S. patent application Ser. No. 871,484 filed Jun. 6, 1986 both abandoned.

BACKGROUND OF THE INVENTION

This invention relates to a mechanical pencil, and in particular, to an automatic mechanical pencil for feeding out a lead in such a manner that when the lead is consumed during the writing, the lead is automatically fed out by releasing the writing tip from the paper surface.

Various types of mechanical pencils which feed out the lead automatically are well known, and most of them are so formed that when the writing stops, the lead is fed out. However many of them are complicated in construction and have a lot of parts and cannot be economically obtained.

Generally, in the usual automatic mechanical pencil for feeding out the lead automatically, there is provided a device which automatically supplies a new lead by a knocking operation when one lead is completely consumed during the writing. When such a device is provided within a main body, the construction inevitably becomes more complicated, and the production costs will become higher.

SUMMARY OF THE INVENTION

One of the objects of this invention is to obtain an automatic mechanical pencil for feeding out the lead automatically, without providing the usual lead supply mechanism for a new lead by the knocking operation in case the lead has completely been consumed, and wherein the pencil body is simply formed.

Another object of this invention is to obtain an automatic mechanical pencil, wherein an automatic feed out mechanism of the lead is provided within a mouth piece to be connected to the main body, and when the mouth piece is detached from the main body, the lead can be directly supplied by hand to the automatic feed out mechanism of the lead.

According to this invention, a chuck mechanism which allows only an advance movement of the lead and a slider mechanism which brings the lead forward, are provided within the mouth piece to be connected to the main body.

Other objects and features of this invention will become apparent from the following detailed description with reference to the accompanying drawings.

DESCRIPTION OF THE PREFERRED EMBODIMENTS

Figure 2:
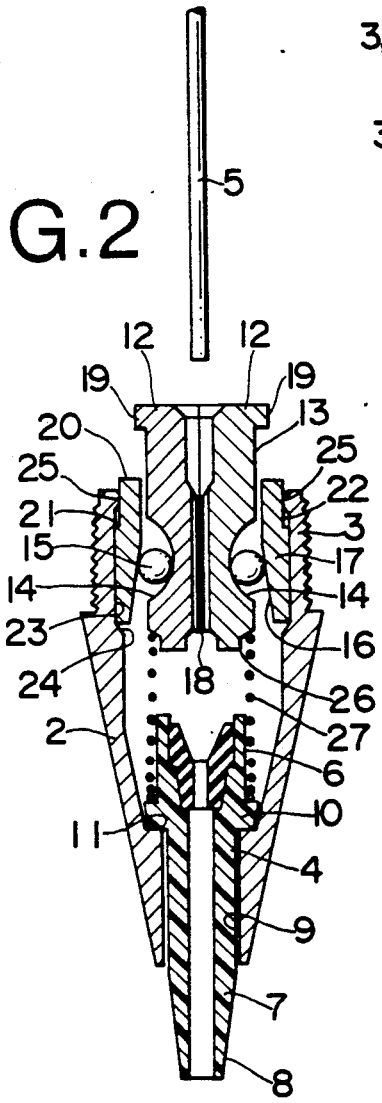
FIG. 2 is an enlarged sectional view of the mouth piece portion of the mechanical pencil according to this invention, under the stat when the lead is not supplied.

In the drawing, a mouth piece (2) detachably connected to a hollow longitudinal main body (1) has a connecting pipe (3) on its rear portion, and a male screw provided on the outer periphery of the connecting pipe (3) is engaged with a female screw provided on the inner periphery of the front end portion of the main body (1), thereby connecting the mouth piece to the main body. The connecting may be effected with a fitting-in coupling and other suitable means instead of the screw coupling. In the tip or front portion of the mouth piece (2), a slider (4) is inserted shiftably in the axial direction. The slider (4) is provided with an elastic piece (6) so as to elastically frictionally hold a lead (5) by the frictional action at the rear portion, while at the front end a lead guide pipe (7) made of the plastic material having a small frictional coefficient is provided. As the plastic material, polyacetal, polyamide, fluororesin and other thermoplastic materials having a low coefficient of friction are used. For the guide pipe (7), a metallic pipe such as a stainless pipe can be used, but when it is made of plastic material as shown in FIG. 2, i.e., polyacetal and polyamide whose coefficient of friction is about 0.15–0.2, the friction between the plastic guide pipe (7) and the lead (5) guided by the guide pipe may be made extremely small. Further, in the drawing, the slider (4) is intergrally formed of the plastic material including the guide pipe (7). However, the guide pipe may be separately made and then combined with the slider (4). The guide pipe (7) is preferably provided with a taper (8) at its front end and is slidably inserted in a bore (9) provided in the mouth piece (2). On the intermediate portion of the slider (4), a flange (10) is provided, and the slider can advance until the flange (10) abuts against a shoulder (11) of the mouth piece (2). The mouth piece (2) may preferably be made of plastic material, such as polyacetal and polyamide, having a similar effect as that of the guide pipe.

Facing the rear portion of the slider (4), there are provided a chuck (13) and a chuck ring (17). The chuck (13) is formed so that it can grip the lead (5) by combining complimentarily arranged plural chuck elements (12),(12) (two of them are shown in the drawing), and the chuck ring (17) is disposed around an outer periphery of the chuck elements (12) and is formed to have an axially forwardly tapered face (16) internally so as to receive balls (15) seated on a concave portion (14) of the outer face of the chuck elements (12). The chuck elements (12) have such shapes as to radially divide a cylinder into nearly halves, having a lead gripping portion (18) with a suitable rough face internally; the front and rear parts of the gripping portion (18) are made so that they form a space having slightly larger diameter, adjacent to a slant, than the diameter of the lead to combine the two chuck elements in facing relation to each other. On the rear portion of the chuck (13), a flange (19) is provided so that it abuts against a rear end (20) of the chuck ring (17) to prevent the chuck and balls from falling out forwardly; however, the flange (19) is not always necessary. The chuck ring (17) is provided with a shoulder (21) rearwardly to form a smaller diameter portion (22) and is pressed in a bore (23) of the connecting pipe (3) under either the state of an idle fitting or a light press fitting. Under this state, the tip of the chuck ring (17) abuts on a slant (24) adjacent to the bore (23); in the smaller diameter portion (22) at the rear portion, an inner projection (25) of the connecting pipe (3) extends inward and the rear end (20) of the chuck ring (17) projects slightly backward.

Since the chuck (13) is formed as mentioned above, when it is shifted backwardly to an axial rear position, (FIG. 2) the balls (15) roll into the narrow portion of the tapered face (16) and the chuck elements (12) are moved radially inwardly to be tightened to exert a first gripping force on the lead. On the other hand, when the chuck (13) shifts forwardly to an axial front position, the balls (15) roll into the wider portion of the tapered face (16), so that the first gripping force exerted by means of the balls and the chuck ring is lessened and the chuck elements (12) move away from each other to loosen their grip on the lead to allow the advance movement of the lead. Thus when in the front position, the chuck elements (12) exert a second gripping force on the lead (5), which is less than the first gripping force so as to permit advancement of the lead past the chuck.

Between the flange (10) of the slider (4) and a tip on front portion (26) of the chuck (13), a spring (27) is provided to urge the slider (4) in the axially forward direction so as to project the front end of the guide pipe (7) of the slider (4) from the tip of the mouth piece (2) and to urge the chuck (13) backwardly so as to hold the chuck in the rear position. By such a construction, the spring force of the spring (27) is transmitted only in the axial direction of the chuck (13) and slider (4).

To assemble each element, the slider (4) is inserted from the rear end of the mouth piece (2); the spring (27) is inserted; the chuck elements (12), (12) are combined; balls (15) are put in and under such a state, the chuck ring (17) is fitted in, and these portions may be forcibly pushed in from the rear portion of the connecting pipe (3) through the inner projection (25). Thereafter, owing to the fact that the flange (10) abuts on the shoulder (11), and the balls (15) are pushed by the tapered portion (16) of the chuck ring (17), the slider and the chuck are prevented from falling out of the mouth piece.

Into the mouth piece (2) assembled as mentioned above, the lead (5) is pushed or loaded from the rear of the chuck (13), and by the tip of the lead, the chuck (13) is advanced toward the front of the mouth piece. When the chuck is advanced to the front position, the first gripping force exerted by means of the spring (27) through the chuck elements (12), the balls (15) and the chuck ring (17) is reduced to the second gripping force and the lead passes through the gripping portion of the chuck, and the front end of the lead advances until it protrudes from the tip of the guide pipe (7) of the slider (4). When the lead is pushed backward under this state, the chuck (13) shifts backward to the rear position and the action of the first gripping force exerted by the chuck elements (12) prevents the lead from retracting. Further, at the rear end of the lead, preferably plastic foam (28) of a shape approximately conforming to the inner wall of the main body (1) is put on, and by the plastic foam, the shock in case of dropping of the pencil is absorbed, thus the breakage of the lead may be prevented. When the main body is formed transparent, the length of the residue lead may be observed.

Figure 1:
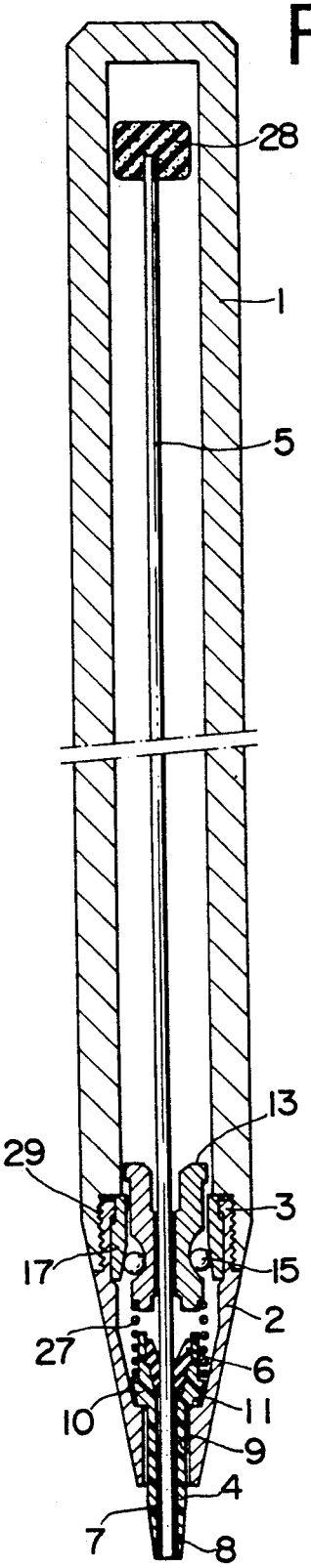
FIG. 1 is a vertical sectional view of an automatic mechanical pencil according to this invention, schematically showing a portion of the main body.

When the mouth piece (2) is connected to the main body (1), the rear end (20) of the chuck ring (17) abuts on a shoulder (29) of the main body (1) facing to the rear end of the connecting pipe (3), as shown in FIG. 1.

Since the lead is gripped by the chuck to prevent the retracting movement of the lead, the writing may be effected and the writing pressure will be received by the shoulder (29) of the main body via the chuck, balls, and the chuck ring. Further, when the inner projection (25) of the connecting pipe has a sufficient mechanical strength, the writing pressure may be received by the projection. During the writing, the slider (4) retracts against the spring (27) with the wear of the lead. However, when the writing is stopped and the writing pressure is removed, the slider is advanced by the spring (27) to undergo a return movement, and the lead frictionally held by the elastic piece (6) is fed out during the return movement of the slider. When the lead advances, the chuck (13) also advances to release the gripping or clamping action by the balls and the chuck ring, so that the advance of the lead is not restricted. Thereafter, the chuck returns backward to the rear position by the spring (27), and the gripping action by the balls and the chuck ring is restored to prevent the retraction of the lead.

When the lead is consumed, the mouth piece may be detached from the main body and the new lead may be supplied or loaded from the rear portion of the chuck. In spite of the removal of the mouth piece, the chuck will never be separated from the mouth piece.

When the slider (4) itself is abutted on the edge of a ruler, the slider will retract. As a result thereof, the lead will project forward from the tip of the guide pipe (7), but in such a case, an embodiment for effecting the retraction of the lead is shown in FIG. 3.

Figure 3:
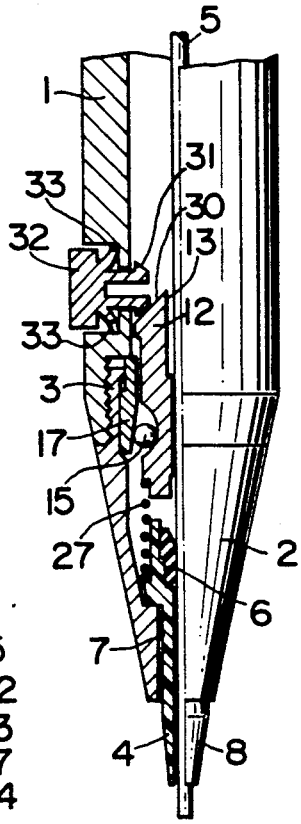
FIG. 3 is a front view of an automatic mechanical pencil according to this invention in case a push button for advancing a chuck is provided, showing a half sectional portion of the pencil along its axial direction.
Figure 4:
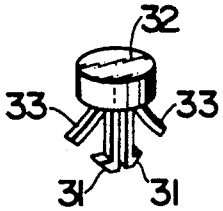
FIG. 4 is a perspective view of the push button shown in FIG. 3.

In FIG. 3, the same reference numbers as in FIG. 1 are used to denote similar elements. In this figure, a slant (30) is provided on the rear end of the chuck (13), and a push button (32) having a slant (31) engaging with the slant (30) is provided on the side of the main body (1) so that the button can freely go in and out. The button (32) is normally put under the state that the slant is not actuated by the elastic legs (33). As shown in FIG. 3, when the lead is put under the projected state, by pushing the push button (32), the chuck (13) is advanced via the slants (30), (31) and the gripping action of the chuck is released so that when the tip of the lead is pushed on a paper face, the tip of the lead aligns with the front end of the guide pipe of the slider, thus the lead can be retracted. Further, the mouth piece may be provided with a cap, and the supply mechanism for the lead may be provided within the main body.

As mentioned above, in this invention, the construction thereof is simple, comprising a small number of parts, so that it may be made economically and used conveniently with few troubles.

It is to be understood that the present invention is not limited to the above mentioned embodiments thereof, but may be otherwise variously modified within the scope of the following claims.

I claim:

1. An automatic mechanical pencil comprising:

a main body having a tip;

a mouth piece connected to the tip of the main body;

a connecting pipe provided at a rear portion of the mouth piece and inserted into an inner portion of the main body;

a slider shiftably inserted in a front portion of the mouth piece and having an elastic piece which frictionally holds a lead;

a chuck comprised of two radially divided chuck elements complimentarily arranged with each other to surround the periphery of the lead, said chuck elements being movably provided in the connecting pipe to slightly shift in the radial direction independently of each other so as to grip the lead with a first gripping force stronger than a writing pressure applied to the lead when the chuck elements are tightened upon the application of the writing pressure and to grip the lead with a second gripping force less than the first gripping force when the chuck elements are loosened to permit advancement of the lead easily when the writing pressure is removed, said chuck elements being slightly shiftable in the axial direction as a whole when the writing pressure is removed;

balls and a chuck ring positioned in the connecting pipe around the outer periphery of said chuck so as to wedge the chuck elements upon the application of the writing pressure, and to release the wedge effect due to the wiring pressure when the writing pressure is removed; and a spring provided between said slider and said chuck to elastically bias the slider to the front portion of the mouth piece and to elastically bias the chuck to a rear portion of the mouth piece, wherein each chuck element has a surface at a front portion to receive one end of the spring to transmit the spring force only in an axial direction of the chuck, and wherein the frictional force exerted by the elastic piece on the lead and the spring force exerted by the spring on the slider are both greater than the second gripping force exerted by the chuck elements on the lead, whereby said chuck elements always hold the lead during the wiring period and during the non-writing period.

2. An automatic mechanical pencil according to claim 1 wherein said slider has a guide pipe projecting from the front portion of the mouth piece, said guide pipe being formed of thermoplastic material having low coefficiency of friction.

3. An automatic pencil for automatically dispensing a lead comprising: a hollow longitudinal main body for receiving therein a lead; a mouth piece detachably connected at a rear end thereof to a front end of the main body for projecting a tip of the lead received in the main body from a front end of the mouth piece; slide means movably disposed in a front portion of the mouth piece for frictionally holding therein the lead, the slide means being manually reciprocatably movable in the axial direction of the pencil in response to writing pressure applied thereto during use of the pencil; chuck means disposed in a rear portion of the mouth piece for releasably clamping the lead during use of the pencil such that the chuck means operates in response to the reciprocating movement of the slide means to exert a smaller gripping force on the lead when no writing pressure is applied thereto to allow advancing movement of the lead toward the front end of the mouth piece and to exert a larger gripping force on the lead when a writing pressure is applied thereto to prevent retracting movement of the lead, the chuck means being removable from the main body together with the slide means when the mouth piece is detached from the main body during loading of a new lead in the chuck means, the chuck means including radially separated chuck elements disposed around the periphery of the lead and movable in the radial direction relative to the lead; and a spring disposed between the slide means and the chuck means to bias the slide means to the front end of the mouth piece and to bias the chuck means towards the rear portion of the mouth piece, wherein each chuck element has a surface at a front portion to receive one end of the spring to transmit the spring force only in an axial direction of the chuck means and wherein the frictional force exerted by the slide means on the lead and the spring force exerted by the spring on the slide means are both greater than the smaller gripping force exerted by the chuck elements on the lead.

4. An automatic pencil according to claim 3; wherein the slide means comprises a guide pipe projecting from the front end of the mouth piece for guiding therethrough the tip of the lead, and an elastic piece in a rear end of the guide pipe for frictionally holding therein the lead guided by the guide pipe.

5. An automatic pencil according to claim 4, wherein the guide pipe is comprised of thermoplastic material having a low coefficient of friction.

6. An automatic pencil according to claim 3; wherein the chuck means includes an axially movable chuck normally urged by the spring in a rearmost position at which the chuck firmly clamps the lead and displaced in response to the return movement of the slide means to a front position at which the chuck releases the lead.

7. An automatic pencil according to claim 3; wherein the chuck means includes actuating means for actuating the chuck elements radially inwardly to cause the same to firmly clamp the lead when the chuck is shifted to the rear position.

8. An automatic pencil according to claim 7; wherein the actuating means comprises a chuck ring fixed on an inner peripheral surface of the rear portion of the mouth piece to receive therein the chuck elements, the chuck ring being tapered in the axially forward direction, and a plurality of balls rollably disposed between the chuck elements and the chuck ring.

9. An automatic pencil according to claim 3; wherein the mouth piece includes a connecting pipe provided at the rear portion of the mouth piece and detachably insertable into an inner portion of the front end of the main body.

10. An automatic mechanical pencil comprising:

a mouth piece having a connecting pipe at a rear portion thereof, a slider housed in the mouth piece and shiftably inserted in a front portion of the mouth piece and having an elastic piece which frictionally holds a lead;

a chuck housed in the mouth piece and comprised of two radially divided chuck elements complimentarily arranged with each other to surround the lead;

a spring housed in the mouth piece to elastically bias the slider to the front portion of the mouth piece and to elastically bias the chuck to the rear portion of the mouth piece;

balls and a chuck ring housed in the mouth piece for tightening the spring-biased chuck elements to exert a first gripping force on the lead when a writing pressure is applied thereto and for loosening the spring-biased chuck elements to exert a second gripping force less than the first gripping force when the writing pressure is released, wherein the balls are provided at the periphery of the chuck elements and the chuck ring coacts with said balls to exert a wedge effect on the chuck elements;

wherein each chuck element has a surface to receive one end of the spring, the surface disposed at a lower portion of the chuck element to transmit the spring force of the spring only in an axial direction of the chuck; and wherein each of the lead-holding force exerted on the lead by the elastic piece of the slider and the spring force exerted by the spring to elastically bias the slider to the front portion of the mouth piece is stronger than the second gripping force exerted on the lead by the chuck elements.

11. An automatic pencil according to claim 10, wherein said chuck ring is fixed in the connecting pipe of the mouth piece.

* * * * *